United States Patent [19]

Martin

[11] Patent Number: 4,692,594

[45] Date of Patent: Sep. 8, 1987

[54] APPARATUS FOR DRYING HAIR FROM THE INSIDE OUT

[76] Inventor: Jack Martin, 434 Rahway Ave., Woodbridge, N.J. 07095

[21] Appl. No.: 793,207

[22] Filed: Oct. 31, 1985

[51] Int. Cl.[4] ..... H05B 1/00; A45D 20/00; A45D 24/00

[52] U.S. Cl. ..... 219/373; 34/3; 34/97; 34/99; 132/7; 132/112; 132/114; 132/118; 219/222; 219/367; 219/369

[58] Field of Search ..... 219/369, 370, 373, 381, 219/382, 367; 34/96–101, 3; 132/7, 9, 11 R, 11 A, 112–118, 126, 142

[56] References Cited

U.S. PATENT DOCUMENTS

| | | | |
|---|---|---|---|
| 724,178 | 3/1903 | Grant | 34/97 X |
| 931,881 | 8/1909 | Marr | 34/99 |
| 1,431,943 | 10/1922 | Gee | 132/114 |
| 1,852,933 | 4/1932 | Maier | 34/97 X |
| 2,073,970 | 3/1937 | Lynch | 132/114 |
| 2,189,430 | 2/1940 | McClure | 34/99 |
| 2,224,876 | 12/1940 | Matys | 34/100 |
| 2,278,112 | 3/1942 | Matys | 34/100 |
| 2,335,553 | 11/1943 | Valverde | 34/100 |
| 2,430,751 | 11/1947 | Woodyard et al. | 34/97 |
| 2,478,559 | 8/1949 | Bergerom | 219/373 X |
| 3,313,036 | 4/1967 | Fortune | 34/99 |
| 4,121,353 | 10/1978 | Baumgartner et al. | 34/99 |

FOREIGN PATENT DOCUMENTS

| | | | |
|---|---|---|---|
| 449906 | 6/1947 | Italy | 132/113 |
| 438268 | 8/1948 | Italy | 34/97 |
| 484925 | 9/1953 | Italy | 219/373 |
| 272949 | 6/1951 | Switzerland | 132/112 |
| 3687 | of 1895 | United Kingdom | 34/97 |
| 406924 | 3/1934 | United Kingdom | 34/97 |

*Primary Examiner*—Anthony Bartis
*Attorney, Agent, or Firm*—Arthur L. Plevy

[57] ABSTRACT

An apparatus for drying hair from the inside out is comprised of a supply tube adapted for connection to a source of air such as a portable electric hair dryer. A plurality of feeder tubes are in communication with the supply tube. A plurality of fingers are in communication with each feeder tube with each finger having a distal end and a length sufficient for supporting the plurality of feeder tubes at locations which for the most part are removed from the hair and avoid a flattening thereof. The fingers also include a plurality of openings for permitting air from the source to dry the hair from the inside out. Adjustable belts are connected to the feeder tubes by fasteners cooperating with the feeder tubes and belts enabling the feeder tubes to be selectively disposed in a predetermined spaced relationship.

9 Claims, 4 Drawing Figures

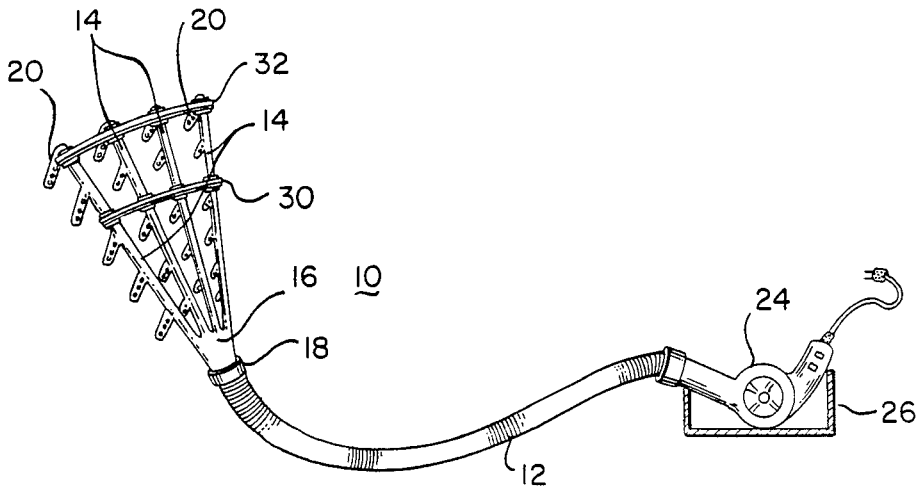
FIG. 1
FIG. 2
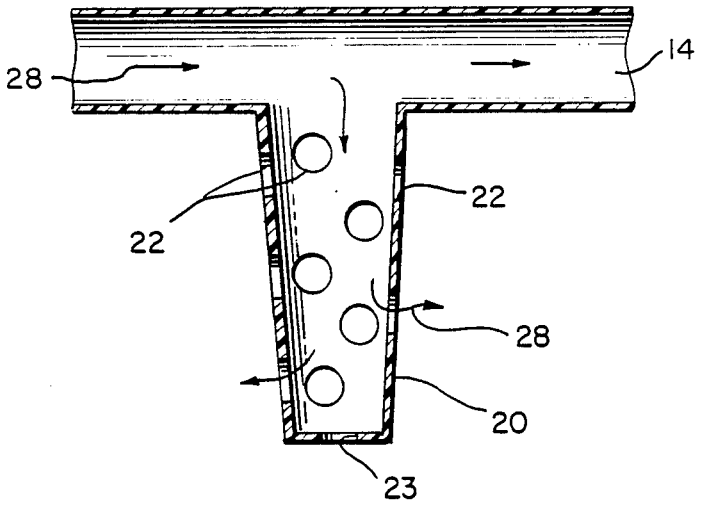

APPARATUS FOR DRYING HAIR FROM THE INSIDE OUT

BACKGROUND OF THE INVENTION

The present invention is directed generally to dryers and more particularly to hair dryers.

Apparatus for drying hair are well known in the art. For example, in U.S. Pat. No. 3,313,036 to R. N. Fortune, issued Apr. 11, 1965, an apparatus is disclosed for drying a portion of an individual's hair. A head-encompassing band assembly is connected to a source of warm air through a telescopic pipe or conduit. The band assembly has a plurality of truncated cones provided with air exits allowing the air to pass over the scalp or forehead of the wearer. This apparatus can be used in conjunction with a hair dryer cap which fits over the band and allows the hair of the individual's entire head to be dried.

In U.S. Pat. No. 3,822,484 to Reed, issued July 9, 1974, a hood is provided with a plurality of swivel valves for directing the flow of air onto the hair to be dried.

In U.S. Pat. No. 4,118,874 to Morane, issued Oct. 10, 1978, and U.S. Pat. No. 4,112,591 to Marsh, issued Sept. 12, 1978, drying apparatus using both suction and forced air are disclosed. These apparatus require a complicated bonnet or helmet to be worn by the user as well as complicated equipment for providing both a suction and a source of forced air.

In U.S. Pat. No. 3,972,126 to DeMuro et al, issued Aug. 3, 1976, a helmet including infrared lamps is used in conjunction with an apparatus for causing a vacuum within the helmet. This apparatus requires a substantial amount of complex equipment in order to effect drying of the hair.

One shortcoming of the prior art, perhaps best seen in the patent to Reed, is that the hair is dried by blowing warm air onto the hair from a source or sources above the hair. The overall effect of such a drying apparatus is that the hair is continually forced against the scalp and tends to become flattened during the drying process. Another drawback found in the prior art is that the user typically must wear a helmet or bonnet which requires independent support. This decreases the comfort of the user and also decreases the user's mobility during drying. Another drawback typical of the prior art is the need for complicated apparatus in order to effect drying. Such apparatus increase the costs of producing and maintaining such a dryer such that only beauty salons or other commercial establishments can afford to purchase and maintain these complicated apparatus.

SUMMARY OF THE PRESENT INVENTION

An apparatus for drying hair from the inside out comprises a supply tube adapted for connection to a source of air. A plurality of feeder tubes are in communication with the supply tube. A plurality of fingers are in communication with the feeder tubes. Each finger has a distal end adapted for supporting the drying apparatus and a plurality of openings for permitting air from the source to dry the hair from the inside out.

The present invention overcomes several of the disadvantages found in the prior art. The plurality of fingers extending from the feeder tubes provide sufficient support for the hair drying apparatus such that no separate support mechanism is required. This increases the comfort as well as the mobility of the user. Additionally, because of the construction of the fingers, the hair is dried from the inside out such that the hair is not flattened against the scalp during drying. This represents a substantial advantage over the prior art. It is anticipated that the supply tube of the present invention may be used in conjunction with any consumer-type hair dryer commercially available. Thus, no complicated apparatus or mechanisms are required. Therefore, the present invention lends itself to mass production techniques, is inexpensive to purchase, and requires virtually no maintenance.

BRIEF DESCRIPTION OF THE DRAWINGS

In order that the present invention can be clearly understood and readily practiced, preferred embodiments will now be described, by way of example only, with reference to the accompanying figures wherein:

FIG. 1 illustrates a drying apparatus constructed according to the teachings of the present invention used in conjunction with a consumer-type hair dryer;

FIG. 2 is a cross-sectional view of one of the fingers illustrated in FIG. 1;

DESCRIPTION OF A PREFERRED EMBODIMENT

Figure 3:
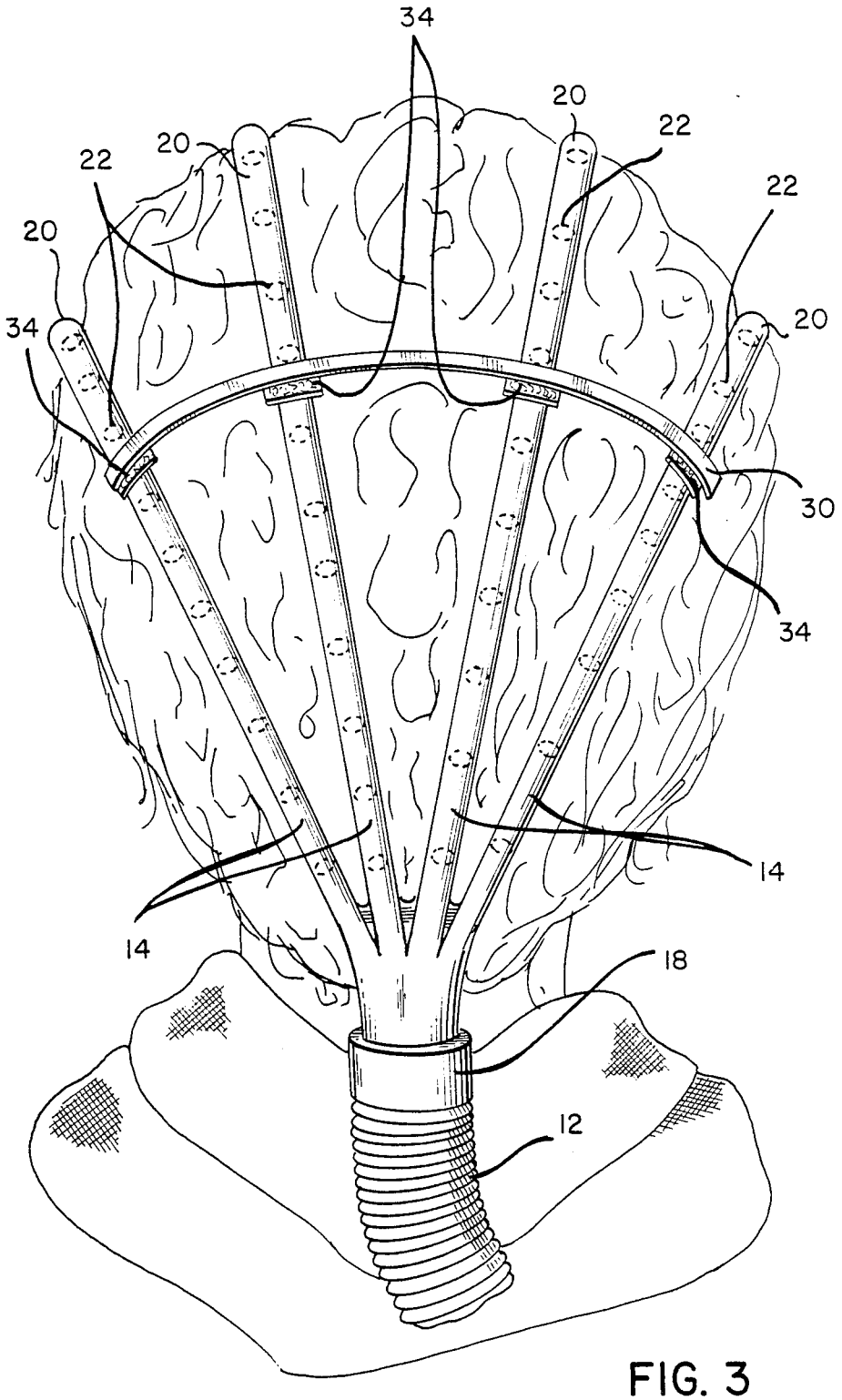
FIG. 3 is a rear view of the drying apparatus illustrated in FIG. 1 positioned on a user.

In FIG. 1, a hair dryer 10 constructed according to the teachings of the present invention is illustrated. The hair dryer 10 is comprised of a supply tube 12 and a plurality of feeder tubes 14. The supply tube 12 may be a flexible tube or conduit as shown in FIG. 1, a non-flexible pipe, or some combination of the two.

The feeder tubes 14 are connected together in the area designated 16 in FIG. 1. The area 16 is in communication with the supply tube 12 through a joint 18. The joint 18 may be a swivel type of joint thus enabling the plurality of feeder tubes 14 to rotate relative to the supply tube 12. In another embodiment, it is anticipated that the swivel joint 18 may be entirely eliminated.

Figure 4:
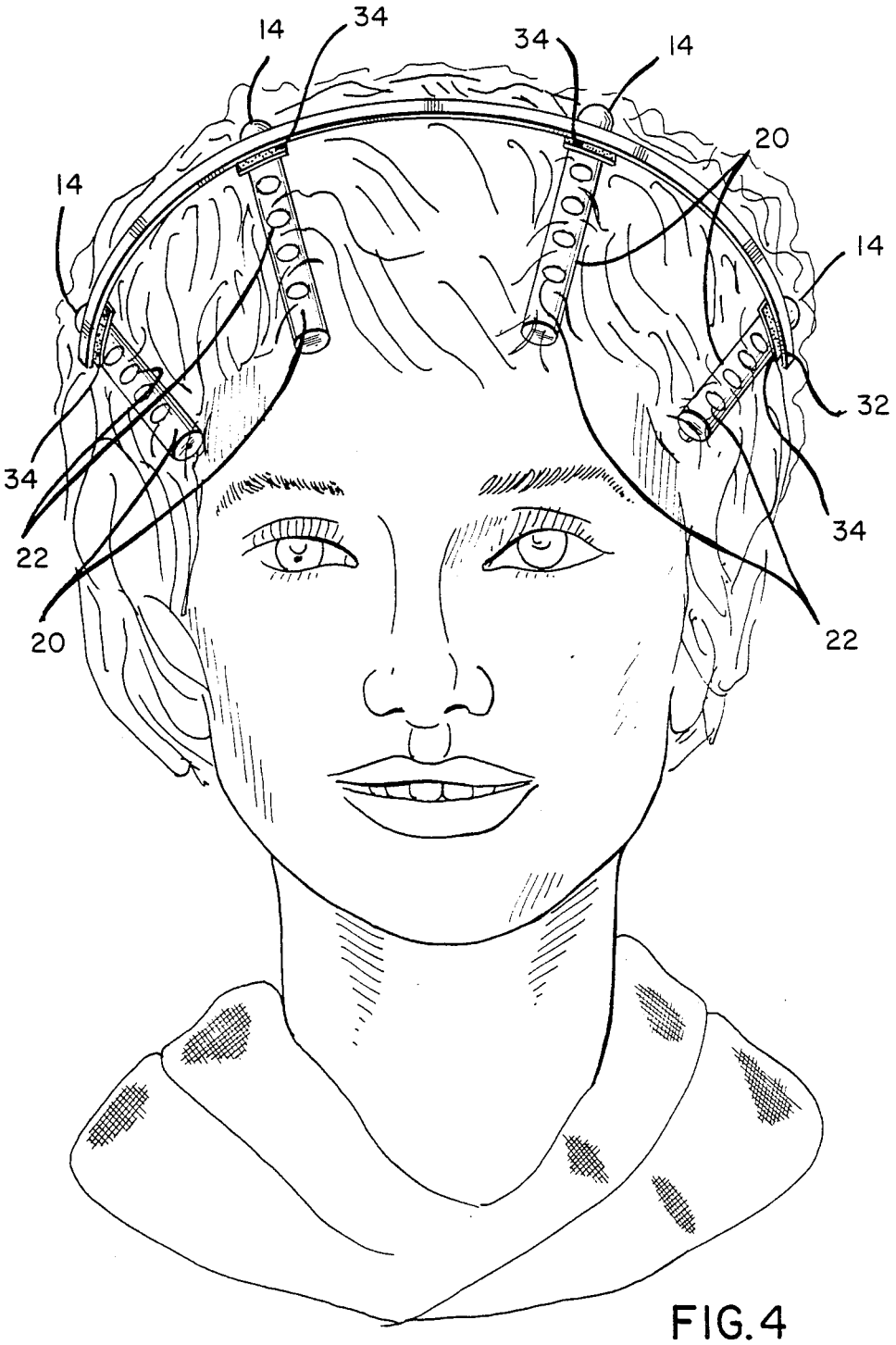
FIG. 4 is a front view of the drying apparatus illustrated in FIG. 1 positioned on a user.

The feeder tubes 14 are comprised of a flexible material such that the feeder tubes conform to the shape of the head of the user as shown in FIGS. 3 and 4. It is anticipated that numerous other configurations of feeder tubes can be devised. These alternative configurations are covered by this specification and the appended claims. The illustration in FIG. 1 of a particular relationship between the feeder tubes 14, and the feeder tubes 14 and the supply tube 12 is illustrated for purposes of illustration only and is not intended to be a limitation.

In FIG. 1, the feeder tubes 14 are interconnected by two belts or straps 30 and 32. The construction and function of the belts 30 and 32 are discussed herein below in conjunction with FIGS. 3 and 4.

Extending from each of the feeder tubes 14, and in communication therewith, are a plurality of fingers 20. Each of the fingers 20 may have a plurality of openings 22.

Also shown in FIG. 1 is a hair dryer 24. The specific type of hair dryer used in conjunction with the present invention is not believed to be critical. It is anticipated that the present invention 10 may be used in conjunction with any number of commercially available hair dryers 24. It is anticipated that the hair dryer 10 may also be sold in conjunction with a stand 26. The stand 26 may be used to support the hair dryer 24 so that a continuous stream of air may be provided. The reader should recognize, however, that the supply tube 12 may be connected to any appropriate source of air.

One of the fingers 20 extending from one of the feeder tubes 14 is illustrated in detail in FIG. 2. As can be seen in FIG. 2, the finger 20 is provided with a plurality of apertures 22. In one embodiment it is anticipated that a distal aperture 23 will also be provided in the distal end of the finger 20. Each of the fingers 20 is constructed such that the distal end may come into contact with the scalp of the user as illustrated in FIG. 4 such that the plurality of fingers 20 support the feeder tubes 14. The plurality of fingers 20 may be of sufficient length such that the plurality of fingers 20 may support the supply tubes 14 above the hair of the user.

The flow of air in the present invention originates at a source, dryer 24 in FIG. 1, travels through the supply tube 12, the feeder tubes 14, the plurality of fingers 20, and outward to the hair through apertures 22 and 23. As shown in FIG. 2 by the arrows 28 and as seen clearly in FIG. 4, the flow of drying air is such that, rather than being blown down onto the hair from above, the drying air circulates outwardly from within the coiffure. In this manner, the hair is dried from the inside out. The hair may be considered to be dried from the roots out especially when fingers having distal end apertures 23 are used. In this manner, the flow of drying air does not flatten the hair of the user. Additionally, because the flow of drying air is uniformly dispersed throughout the user's hair, the hair is not exposed to excessive forces which might damage the hair.

As illustrated in FIGS. 3 and 4, because of the flexibility of the feeder tubes 14 the apparatus 10 of the present invention may be positioned within the user's hair in any manner which will promote efficient drying. It is also anticipated that the belts 30 and 32, shown in FIGS. 3 and 4, respectively, may be used in order to hold the feeder tubes 14 in the proper orientation. The belts 30 and 32 may be provided with connecting means, such as Velcro hooks (not shown), which mate with Velcro loops 34 thereby enabling the adjustment of the feeder tubes 14 relative to one another. Once an appropriate orientation for the feeder tubes 14 has been ascertained, the belts 30 and 32 may be adjusted such that the proper orientation is maintained. Those of ordinary skill in the art will realize that any type of fastener may be used in place of the Velcro hooks and loops.

It is anticipated that the apparatus of the present invention may be integrally molded. In this manner, the supply tube 12, feeder tubes 14, and fingers 20 would all be formed in a single unitary piece. The apparatus of the present invention lends itself to mass production techniques thus resulting in lower cost. Because the apparatus of the present invention has no moving parts, it is anticipated that virtually no maintainance will be necessary. Additionally, the dryer of the present invention may be used with any number of commercially available hair dryers, is simple to use, and does not unduly restrict the mobility of the user. Because the air circulates outwardly from within the coiffure the hair is not flattened as with prior art dryers, nor is the hair subjected to excessive force which might damage the hair. These represent substantial advantages over the prior art.

While the present invention has been described in connection with an exemplary embodiment thereof, it will be understood that many modifications and variations will be readily apparent to those of ordinary skill in the art. This application and the following claims are intended to cover those modifications and variations.

What I claim is:

1. Apparatus for drying hair from the inside out, comprising:

a supply tube adapted for connection to a source of air;

a plurality of feeder tubes in communication with said supply tube;

a plurality of fingers extending from each of said feeder tubes, each of said fingers being in communication with and extending from differing portions of respective ones of said plurality of feeder tubes and having a distal end and a length sufficient for supporting said plurality of feeder tubes at locations which for the most part are removed from said hair, and each finger having a plurality of openings for permitting air from the source to dry the hair from the inside out;

adjustment belt means connecting to said plurality of feeder tubes for maintaining said feeder tubes in an established spaced relationship; and fastener means cooperating with at least selected ones of said plurality of feeder tubes and said adjustment belt means for individually and selectively varying the spacing of said selected ones of said plurality of feeder tubes within said established spaced relationship.

2. The apparatus of claim 1 wherein said distal ends of said fingers are adapted to rest on the scalp.

3. The apparatus of claim 1 wherein said plurality of openings are positioned to enable the hair to be dried outwardly from the roots.

4. The apparatus of claim 3 wherein said fingers have an opening located at the distal end thereof.

5. The apparatus of claim 1 wherein said supply tube is adapted for connection to a consumer-type hair dryer.

6. The apparatus of claim 5 additionally comprising a holder for supporting the hair dryer.

7. The apparatus of claim 1 wherein said plurality of feeder tubes and said plurality of fingers are comprised of one integrally molded piece.

8. The apparatus of claim 1 wherein said supply tube includes a flexible hose.

9. Apparatus for drying a coiffure from the inside out, comprising:

a supply tube adapted for connection to a source of air;

a plurality of feeder tubes in communication with said supply tube;

a plurality of fingers in communication with and extending from each of said plurality of feeder tubes, each finger extending from respective ones of said plurality of feeder tubes extending from differing portions thereof and having a distal end adapted for contacting the scalp and a length sufficient to support said feeder tubes above the coiffure, each finger having a plurality of openings for permitting air from the source to dry the hair from the inside of the coiffure out;

adjustment belt means connecting to said plurality of feeder tubes for maintaining said feeder tubes in an established spaced relationship; and fastener means cooperating with at least selected ones of said plurality of feeder tubes and said adjustment belt means for individually and selectively varying the spacing of said selected ones of said plurality of feeder tubes within said established spaced relationship.

* * * * *